US005344076A

United States Patent [19]

Mercurio

[11] Patent Number: 5,344,076

[45] Date of Patent: Sep. 6, 1994

[54] HAIRSPRAY APPLICATOR

[76] Inventor: Anthony Mercurio, 2296 William Ct., Yorktown Heights, N.Y. 10598

[21] Appl. No.: 982,154

[22] Filed: Nov. 25, 1992

Related U.S. Application Data

[63] Continuation of Ser. No. 717,529, Jun. 19, 1991, abandoned, which is a continuation-in-part of Ser. No. 503,995, Apr. 3, 1990, abandoned.

[51] Int. Cl.[5] ..... B05B 1/28

[52] U.S. Cl. ..... 239/120; 239/288.5

[58] Field of Search ..... 239/288–288.6, 239/124, 120, 375, 373; 222/182

[56] References Cited

U.S. PATENT DOCUMENTS

| | | | |
|---|---|---|---|
| 2,597,573 | 5/1952 | DeGoff | 239/288 |
| 2,985,382 | 5/1961 | Coplan | 239/337 X |
| 3,191,867 | 6/1965 | Helms | 239/288.5 |
| 3,211,384 | 10/1965 | Seaquist | 239/288.5 X |
| 3,628,702 | 12/1971 | Kimura | 222/402.13 |
| 3,887,115 | 6/1975 | Petterson | 239/288.5 X |
| 3,916,917 | 11/1975 | Hubbard | 132/9 |
| 4,098,436 | 7/1978 | Kohlbeck | 239/375 X |
| 4,361,158 | 11/1982 | Baker | 132/9 |
| 5,099,830 | 3/1992 | Kishimoto | 239/520 X |

FOREIGN PATENT DOCUMENTS

| | | | |
|---|---|---|---|
| 52561 | 1/1977 | Japan | 132/319 |

*Primary Examiner*—Andres Kashnikow
*Assistant Examiner*—Kevin Weldon

[57] ABSTRACT

A spray applicator for the use in applying hairspray and the like to the hair of a person while preventing the build-up of excess fumes in the area of the person and the operator. A generally cone-shaped applicator is provided with an exhaust port through which fumes in the cone are exhausted, the applicator including a holder for holding a spray source such as a can or bottle, and a means for activating the release of spray from the can or bottle. The cone-shaped applicator is generally concave along a portion of its outlet end to be fitted against the person's head, neck, or face. Spray is released into the cone and onto the person's hair while fumes that are developed are substantially trapped within the cone and exhausted through an exhaust port at the top of the cone. The applicator cone is lightweight and transparent, which allows the operator to view the hair treatment during application of the spray, without adverse effects from fumes.

11 Claims, 2 Drawing Sheets

HAIRSPRAY APPLICATOR

This application is a continuation of co-pending application Ser. No. 07/717,529, filed Jun. 19, 1991 and now abandoned. Application Ser. No. 07/717,529 is a continuation-in-part of 07/503,995 filed Apr. 13, 1990 now abandoned.

FIELD OF THE INVENTION

This invention relates to a hairspray cone exhaust adapted for use in beauty parlors or the home in the application of hairspray and the like to the hair of a customer (for example by an operator), and more particularly to a cone-shaped hairspray device which expels fumes within the cone to an exhaust system thereby creating a more clean and safe environment for the application of hairsprays and the like.

BACKGROUND ART

In beauty shops hairsprays are customarily applied to the hair of customers in the course of hair treatment and styling procedures by spraying from pressurized cans and manually operated spray bottles. This operation results in the dispersion of substantial quantities of hairspray fumes throughout the area in which such operations are being carried out, which may be occupied by numerous customers and operators. Because of the spray composition, the fumes thus dispersed may be exceedingly irritating to those persons in the area in which it is being used, and may even be deleterious to their health.

In the prior art, the prevention of excess fumes has only been with respect to the use of devices such as shields, etc. to block fumes. No one has demonstrated or described a portable and lightweight device which can be used to actively exhaust fumes and which can be readily used with any customer and any type of hair treatment involving the application of sprays.

Accordingly, it is a primary object of the present invention to provide a device for permitting the application of hairspray and the like to the hair of a person while simultaneously expelling fumes away from the person and the operator.

It is another object of this invention to provide a lightweight, portable device that can be used for the application of hairsprays and the like without creating an environment of irritating fumes, and which can be readily adapted for use with any type of spray or hair treatment.

It is another object of this invention to provide a device which is usable for the application of hairspray to a customer in a manner to prevent the build-up of excess fumes in the area of the customer and the operator, where the device allows the operator to view the hair of the customer during application of the hairspray.

It is another object of this invention to provide a hairspray applicator which exhausts fumes from the area of the customer and the operator, which device can be easily moved to different positions around the hair of the customer while providing effective exhaust of fumes.

It is still another object of the present invention to provide a device for applying hairspray and the like to the hair of a customer without the build-up of excess fumes, where the device can be used with any size and shape of the container carrying the hairspray or the like.

It is another object of this invention to provide a device for the application of hairsprays and the like to a person which will prevent the build-up of excess amounts of fumes, where the device can be used for this purpose without regard to the hairstyle of the person.

BRIEF SUMMARY OF THE INVENTION

The spray application device of this invention includes a transparent cone of lightweight, unbreakable plastic or other suitable material having a holder connected therewith for holding a source of hairspray or the like, there being an exhaust port located in the cone through which hairspray fumes are extracted. The device is portable and can be easily moved around the head of the person undergoing the hair treatment. Fumes are exhausted through the exhaust port located on the top of the cone, a flexible tubing being connected to the exhaust port to allow the fumes to be carried away. The flexible tubing can be connected to an exhaust system, such as a vacuum pump, for removal of the fumes, or there may be sufficient back pressure in the tubing to cause a natural flow of fumes away from the person (and the operator if he or she is another person).

The transparent cone is shaped in a manner to substantially surround the head of the person so that most of the fumes generated during the spraying operation are contained within the cone rather than being disposed into the area around the person's head. The fumes trapped within the cone escape, or are sucked out, through the exhaust port.

This spray applicator can be easily hand-held and will accommodate spray containers of varying shape and size while allowing the operator to easily dispense the spray without the need for awkward movements. Due to the shape of the outlet of the cone, the particular style of the customer's hair does not limit the effectiveness of this fume-removal applicator.

These and other objects, features, and advantages will be apparent from the following more particular description of the preferred embodiments.

DETAILED DESCRIPTION OF THE PREFERRED EMBODIMENTS

Figure 1:
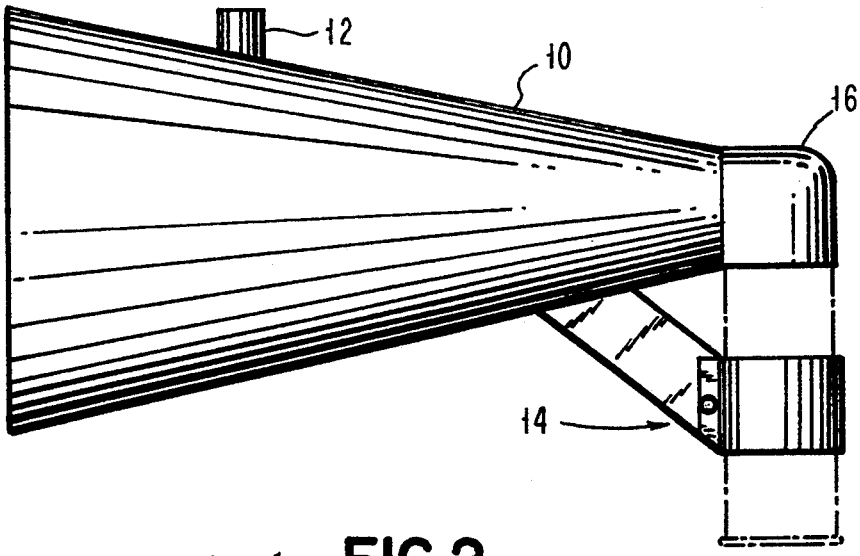
FIG. 1 is a side perspective view of the spray applicator of this invention illustrating its general cone shape.

The spray applicator of this invention is shown in FIG. 1 wherein a cone-shaped section 10 has an exhaust port 12 located on the top thereof. Cone 10 is preferably made of a lightweight, clear unbreakable plastic or similar material which is transparent so as to permit ready observation by the operator of the hair of the person to be sprayed. Attached to cone 10 is a holding means 14, which can be used to hold an aerosol hairspray can (shown in phantom lines in FIG. 1). Holder 14 is adjustable to be able to accommodate applicator containers, such as cans and bottles, of varying diameter and length.

Figure 2:
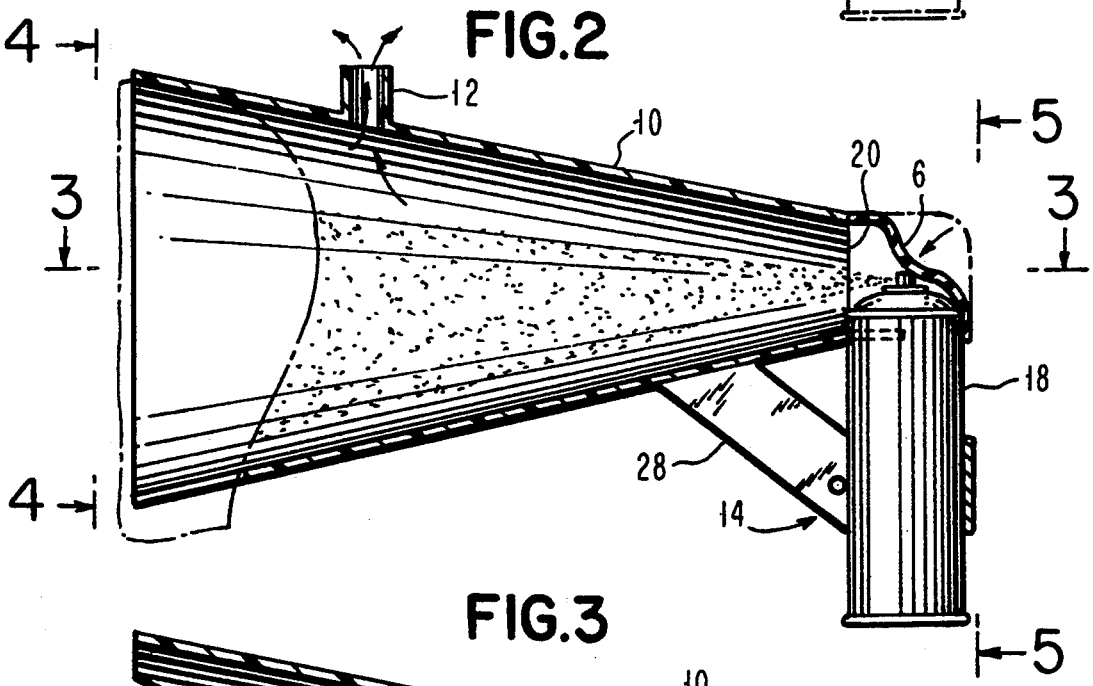
FIG. 2 is a cross section of the applicator shown in FIG. 1, showing the applicator in further detail and specifically illustrating the operation of the applicator when a hairspray applicator can is in place and when the hairspray is flowing through the cone toward the hair of the customer, this figure also illustrating the removal of exhaust fumes through the exhaust port at the top of the cone.

Also attached to cone 10 is a flexible end member 16 (activation means) into which the top of the can or bottle extends (as shown in FIG. 2). Flexible member 16 can be depressed to activate the can nozzle for release of its spray contents into cone 10. End member 16 is comprised of rubber, nylon, etc. to allow its deflection by the operator. This rubber or other material can also extend as a coating along the surface of cone 10 to which it is firmly adhered.

FIG. 2 illustrates a cross sectional view of the spray applicator of FIG. 1, illustrating its use for the application of a hairspray and the exhaust of fumes within cone 10. In this figure, an aerosol spray can 18 is in place in holder 14 and end member 16 is depressed against the can nozzle to activate the spray can 18. This causes the dispersion of spray into cone 10 through the opening 20 at the back of cone 10. The spray follows the cone 10 to the person's hair, cone 10 being placed in contact with the person's head. Fumes which are built-up within cone 10 are exhausted through the exhaust port 12 located at the top of cone 10. A flexible plastic hose (not shown) can be connected to port 12 and to an exhaust system in order to expel fumes from within the cone. It will be understood that if such an exhaust system is provided the build-up of fumes within cone 10 will be minimized, as will be any leakage of fumes from the front end of the cone.

Figure 3:
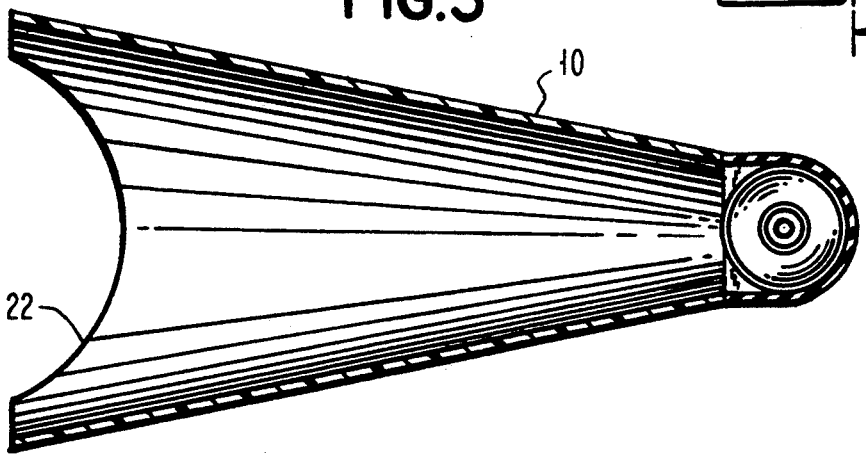
FIG. 3 is a bottom view of the spray applicator of this invention, showing the concave shape of the outlet portion of the cone which allows the cone to conform to the generally rounded shape of a person's head and neck.

FIG. 3 is a bottom view of the spray applicator of FIG. 1, indicating the generally concave edge 22 at the bottom of cone 10. This concave edge is chosen to generally conform to the generally rounded shape of a person's head and neck, allowing the spray applicator to be closely pressed against the person's head and neck to minimize dripping of excess spray particles and also to minimize the loss of fumes from the front of cone 10.

Figure 4:
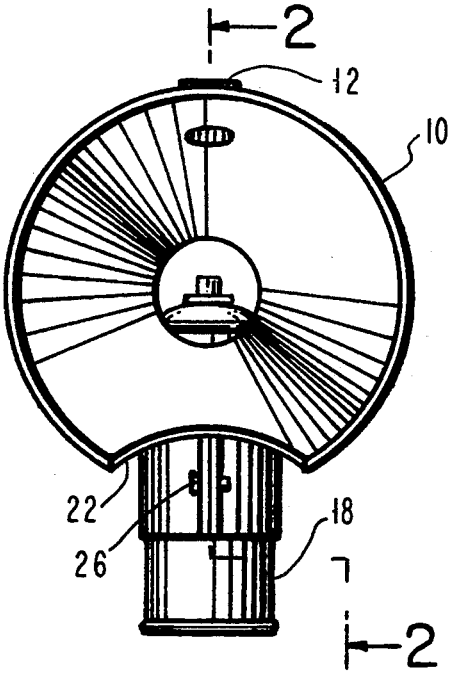
FIG. 4 is a front view of the spray applicator of FIG. 1, looking directly into the cone itself.

FIG. 4 is a front view of the spray applicator of this invention, looking down cone 10 toward the nozzle of the hairspray can 18. This view illustrates the concave section 22 of the front opening of cone 10, as well as the location of the exhaust port 12. The concave section 22 can be moved easily along the contour of a person's head, neck, or face and will form protection against the hairspray in order to localize the application of the spray. It will also be appreciated by those skilled in the art that the diameter of the opening of the cone 10 can be varied by using different size cones, depending upon whether the customer is a child or an adult. Further, different size cones can be used for the same person depending upon the degree to which application of the spray must be localized.

Figure 5:
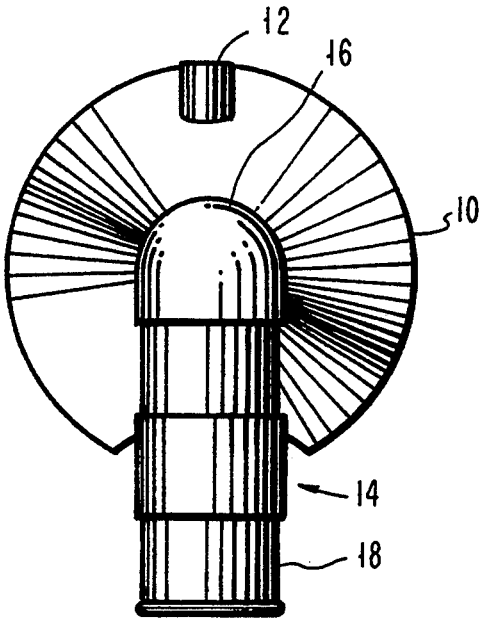
FIG. 5 is a rear view of the spray applicator shown in FIG. 1, looking directly at the spray can and the rear of the cone.

FIG. 5 is a rear view of the spray applicator of the present invention showing the aerosol can 18 in place within holder 14. This view also shows the flexible end member 16 and the exhaust port 12.

Figure 6:
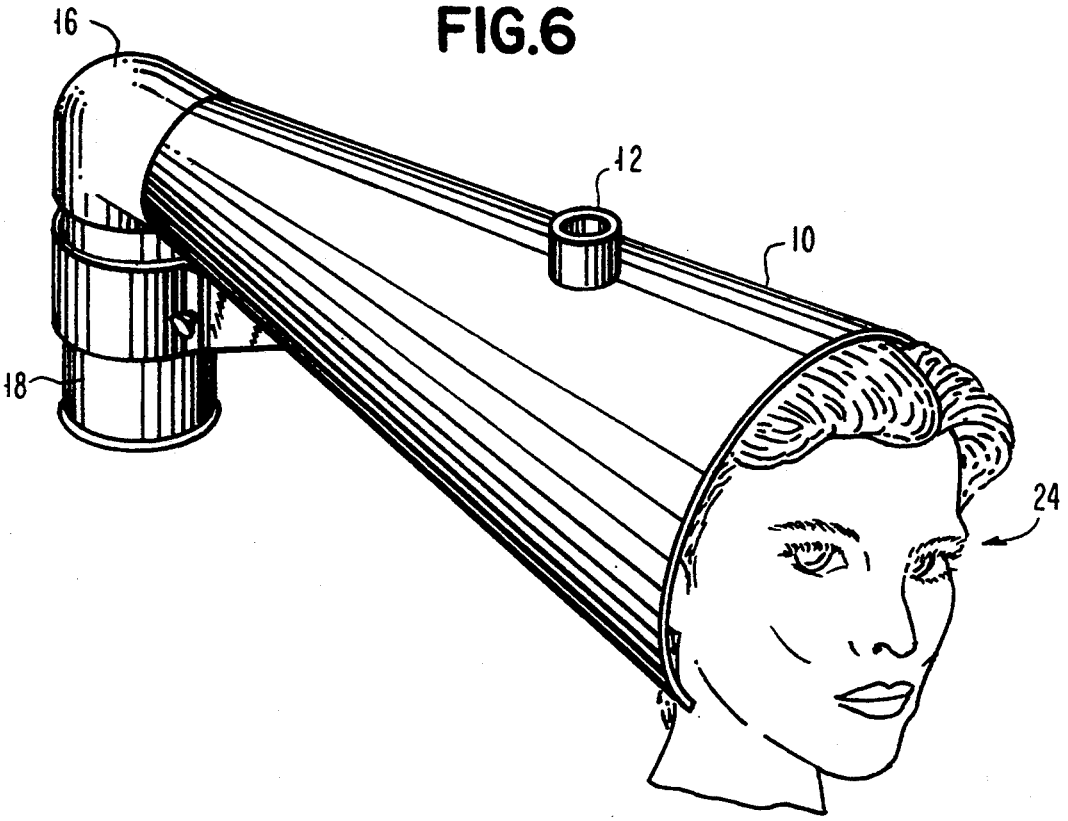
FIG. 6 is a perspective view, generally a front-side view, showing the cone in place on the rear section of a person's head.

FIG. 6 illustrates the use of the spray applicator of the present invention, and specifically depicts a person 24 to whom spray is being applied. The size of the cone 10 in this figure is such that the cone can be placed over and will accommodate substantially all of the head of the person 24 while leaving sufficient space between the cone and the hair of the person to permit application of desired amounts of hairspray to the rear section of the person's hair. This hand-held spray applicator can be moved up, down, and around a person's head to disperse spray evenly. During this operation, fumes that are generated within cone 10 will be exhausted through port 12. As an option, the cone can be swiveled within end member 16 to allow it to be applied at different angles to a person's hair.

The spray container holder 14 includes an adjustment means, such as wing nut 26 shown in FIG. 4, to allow cans or bottles of varying diameter to be held. The source of the spray can be, as noted, aerosol spray cans or bottles, or non-aerosol containers. The holder means 14 also includes a hinge member 28, shown in FIG. 2, which allows the holder 14 to accommodate spray containers 18 of varying length and width.

End member 16 is generally rubber or other type of flexible material. This material generally forms a tight seal with the rear end of cone 10, in order to ensure that the spray from can or bottle 18 is primarily directed into cone 10, and to prevent the exhaust of excess quantities of fumes through the rear of the spray applicator.

In the practice of this invention, a structure is provided which can be used to apply any type of spray to a person's hair, while actively exhausting fumes which accompany the application of sprays. This spray applicator can be adapted for use with people of all ages, of different hair styles, and of differing head, neck, and facial shapes. It is portable and lightweight and allows an operator to view the application of the spray without danger from irritating fumes.

While the invention has been shown with respect to particular embodiments thereof, it will be apparent to those of skill in the art that variations can be made therein without departing from the spirit and scope of the present invention. For example, geometries which depart somewhat from a cone shape can be utilized and various types of spray holders and other materials can be used in addition to those specifically described.

I claim:

1. A spray applicator for spraying particles onto a person's hair, comprising:

a generally cone-shaped funnel having an outlet end of sufficient diameter to enclose a substantial portion of a person's head, said outlet end containing a concave portion generally adapted to be placed against a person's head, neck, or face and an inlet end to which a source of spray is attached, an exhaust port located in said cone-shaped funnel through which fumes developed by said spray can exhaust from said funnel, holding means attached to said funnel for holding a source of said spray at said inlet end, said holding means being adjustable for securely holding spray sources of different sizes, pliable activation means attached to the inlet end of said funnel into which said spray source extends, said pliable activation means being depressible to activate said spray source to cause the dispersion of spray particles within said funnel, said activation means including a flexible region providing a generally air-sealing closure at the inlet end of said funnel.

2. The spray applicator of claim 1, where said holding means includes means for accommodating sources of spray of differing sizes.

3. The spray applicator of claim 2, wherein said cone-shaped funnel is comprised of a material that is optically transparent to visible wavelengths.

4. The spray applicator of claim 3, wherein said activation means is comprised of a pliable member at the inlet end of said funnel, said pliable member being depressible to activate the expulsion of spray from said spray source.

5. The spray applicator of claim 4, where said exhaust port withdraws fumes from said cone-shaped funnel.

6. A spray applicator for applying spray to the hair of a person without the build-up of excess spray fumes, said applicator comprising:

a generally cone-shaped funnel adapted to be easily moved around the head of a person, said funnel having an outlet end of sufficient diameter to provide a space between said cone and the hair of said person, said outlet portion including a generally curved concave base section adapted to contact the head, neck, or face of said person to protect said person from direct contact with said spray, holding means attached to said cone-shaped funnel for holding a source of said spray having a spray nozzle, said holding means being adjustable for securely holding spray sources of differing sizes, activation means attached to the inlet end of said cone-shaped funnel, said activation means including a pliable member providing a seal at the inlet end of said funnel and being depressible against said spray nozzle for activating said source of spray, said source of spray extending into said activation means so that, upon activation of said source of spray, said spray will be released into the inlet end of said funnel and will travel toward the outlet end of said cone-shaped funnel, and an exhaust port located in said cone-shaped funnel through which fumes generated from said spray exit said funnel, said cone-shaped funnel being transparent to allow a visual examination of the spraying operation.

7. The spray applicator of claim 6, wherein said spray source is a can or bottle which is held by said holding means at a position such that the nozzle of said spray source is adjacent the opening at the inlet end of said cone-shaped funnel.

8. The spray applicator of claim 7, where said activation member is comprised of a pliable material which can be depressed to activate the nozzle of said spray source.

9. A spray applicator for spraying a person's hair while exhausting fumes which occur during spraying, comprising:

a lightweight generally cone-shaped funnel having an inlet end at which said spray enters said funnel and an outlet end through which said spray exits to be applied to a person's hair, said inlet end being generally sealed with a pliable end member having an opening therein through which a spray container having an output nozzle extends such that its output nozzle is located adjacent said inlet end of said funnel, said pliable end member being pliant to allow depression thereof to activate the nozzle of said spray container for the release of spray into said funnel, the outlet end of said funnel having a diameter of a size which allows said outlet end to enclose a substantial portion of the head of said person to allow the application of spray to a desired section of a person's hair, said outlet end having a generally curved concave portion thereof which allows the outlet end of said funnel to be closely held against the person's head, neck, or face, thereby substantially preventing spray from striking areas of the person other than where said spray is intended to be applied, an exhaust port located in said funnel through which fumes developed by said spray are exhausted from said funnel, and holding means attached to said funnel for holding said spray container so that said output nozzle of said spray container is located adjacent said inlet opening to said funnel, said holding means including adjustable means for holding spray containers of differing sizes.

10. The spray applicator of claim 9, where said end member is pliant to allow depression to activate the output nozzle of said spray container for release of spray into said funnel.

11. The spray applicator of claim 10, where said funnel is of lightweight transparent material, said spray applicator being hand-held.

* * * * *